US005981930A

United States Patent [19]

Inoue et al.

[11] Patent Number: 5,981,930

[45] Date of Patent: Nov. 9, 1999

[54] CANISTER FOR PREVENTING THE EMANATION OF A VAPORIZED FUEL GAS

[75] Inventors: Masajiro Inoue; Jun Takizawa, both of Wako, Japan

[73] Assignee: Honda Giken Kogyo Kabushiki Kaisha, Tokyo, Japan

[21] Appl. No.: 09/154,820

[22] Filed: Sep. 17, 1998

[30] Foreign Application Priority Data

Sep. 25, 1997 [JP] Japan ..... 9-260536

[51] Int. Cl.[6] ..... H05B 6/62

[52] U.S. Cl. ..... 219/772; 219/780; 219/202; 219/383

[58] Field of Search ..... 219/200, 201, 219/202, 205, 206, 383, 772, 780; 392/311, 320; 123/519; 96/108

[56] References Cited

U.S. PATENT DOCUMENTS 3,891,828 6/1975 De Corso ..... 219/383

5,064,995 11/1991 Pesta ..... 219/383

FOREIGN PATENT DOCUMENTS 6-280694 10/1994 Japan .

*Primary Examiner*—Tu Ba Hoang

*Attorney, Agent, or Firm*—Nikaido, Marmelstein, Murray & Oram LLP

[57] ABSTRACT

A canister is provided for preventing the emanation of a vaporized fuel gas. The canister is capable of quickly heating the activated carbon through the resistance thereof up to a required temperature at the time of desorption of the vaporized fuel gas. The canister comprises a container having a vaporized fuel gas inlet port and an exit port. An aggregate of activated carbon is filled in the container to adsorb the vaporized fuel gas, and at least a pair of electrodes are provided for heating the activated carbon through the resistance thereof, at the time of desorption of the vaporized fuel gas. A highly electrically conductive activated carbon is used having an electric resistance of not larger than 500 $\Omega/2.5^3$ $cm^3$.

2 Claims, 8 Drawing Sheets

CANISTER FOR PREVENTING THE EMANATION OF A VAPORIZED FUEL GAS

BACKGROUND OF THE INVENTION

1. Field of the Invention

The present invention relates to a canister mounted on an automobile for preventing the emanation of a vaporized fuel gas and, more particularly, to an improvement in the canister comprising a container having a vaporized fuel gas inlet port and an exit port, an aggregate of activated carbon in the container for adsorbing the vaporized fuel gas, and at least a pair of electrodes for heating the activated carbon through the resistance of the activated carbon, at the time of desorption of the vaporized fuel gas.

2. Description of the Prior Art

The present assignee has previously proposed a canister of this type in Japanese Patent Laid-Open No. 6-280694. The activated carbon is heated through the resistance of the activated carbon at the time of desorption of the vaporized fuel gas from the standpoint of raising the temperature of the vaporized fuel gas adsorbed by the activated carbon, in order to enhance the kinetic energy and to promote the desorption of the vaporized fuel gas from the activated carbon.

The canister is deteriorated by the accumulation of residual gas that remains adsorbed by the activated carbon but is not desorbed. In order to enhance the durability of the canister, the desorption must be effected efficiently and to a sufficient degree.

In the widely known canister using general activated carbon, however, an electric current flows in small amounts between the two electrodes due to a high electric resistance and, as a result, there is a problem that it is difficult to heat the activated carbon up to a required temperature.

SUMMARY OF THE INVENTION

The object of the present invention is to provide a canister which is capable of quickly heating the activated carbon by means of the resistance of the activated carbon, up to a required temperature, by increasing the amount of current that flows between the two electrodes by using activated carbon having a low electric resistance, despite a low voltage at the time of desorption of the vaporized fuel gas.

In order to accomplish the above-mentioned object according to the present invention, there is provided a canister for preventing the emanation of a vaporized fuel gas comprising a container having a vaporized fuel gas inlet port and an exit port, an aggregate of activated carbon within the container to adsorb the vaporized fuel gas, and at least a pair of electrodes for heating the activated carbon through the resistance thereof at the time of desorption of the vaporized fuel gas, wherein the activated carbon is highly electrically conductive and has an electric resistance of not larger than 500 $\Omega/2.5^3$ $cm^3$.

The above-mentioned highly electrically conductive activated carbon can be quickly heated through the resistance thereof up to a required temperature with a voltage of 12 V of a battery mounted on a car. This makes it possible to desorb the vaporized fuel gas efficiently and to a sufficient degree. Furthermore, owing to its quick response, the desorption can be effected depending upon the operating conditions of an engine. Accordingly, the vaporized fuel can be reliably supplied to the engine. However, the desorption of the vaporized fuel gas is deteriorated as the electric resistance of the highly electrically conductive activated carbon exceeds 500 $\Omega/2.5^3$ $cm^3$.

Another object of the present invention is to provide a canister which is capable of adsorbing the vaporized fuel gas to a sufficient degree and of favorably desorbing the vaporized fuel gas that has been adsorbed. In order to accomplish this object according to the present invention, there is provided a canister in which at least part of the highly electrically conductive activated carbon in the aggregate has an average porous diameter of not smaller than 7 Åbut not larger than 37 Å.

The vaporized fuel gas obtained from the gasoline which is a fuel, contains a variety of chemical components. The chemical components, except butane-type components, can be sufficiently adsorbed by general activated carbon having a relatively large average porous diameter. However, the butane-type components adhere to the general activated carbon but readily undergo the desorption. Accordingly, the butane-type components are adsorbed in small amounts.

The present inventors have considered the molecular sieve property of the activated carbon, i.e., have considered that there are some relationships between the average porous diameter and the adsorption (adhesion and holding) of the butane-type components, and have studied the relationships and have arrived at setting the above-mentioned average porous diameter. That is, once the butane-type components are adhered to the activated carbon having the above-mentioned average porous diameter, the activated carbon exerts the property for holding the butane-type components until the desorption operation is effected. Therefore, the above-mentioned activated carbon is capable of adsorbing the vaporized fuel gas to a sufficient degree.

Moreover, the activated carbon is highly electrically conductive and permits the vaporized fuel gas to be favorably desorbed upon the heating of the activated carbon due to the resistance thereof.

A phenomenon occurs when the average porous diameter is smaller than 7 Å, in that the butane-type components are not smoothly adsorbed and when the average porous diameter exceeds 37 Å, on the other hand, the butane-type components that are once adhered are readily desorbed.

DETAILED DESCRIPTION OF THE PREFERRED EMBODIMENT

Figure 1:
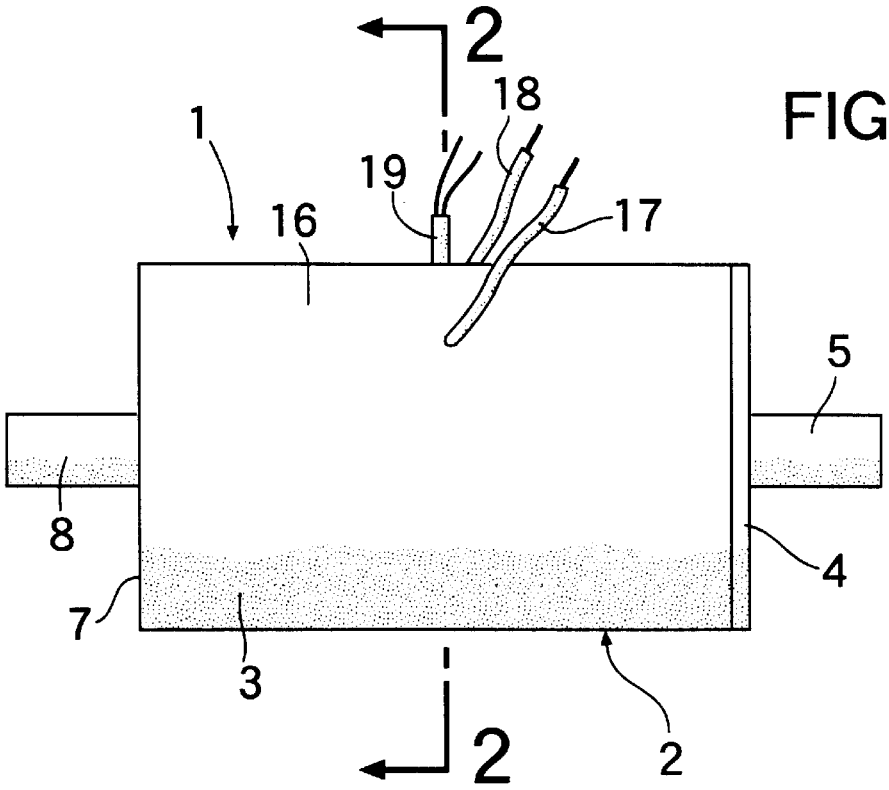
FIG. 1 is a front view of a canister according to an embodiment of the present invention.
Figure 2:
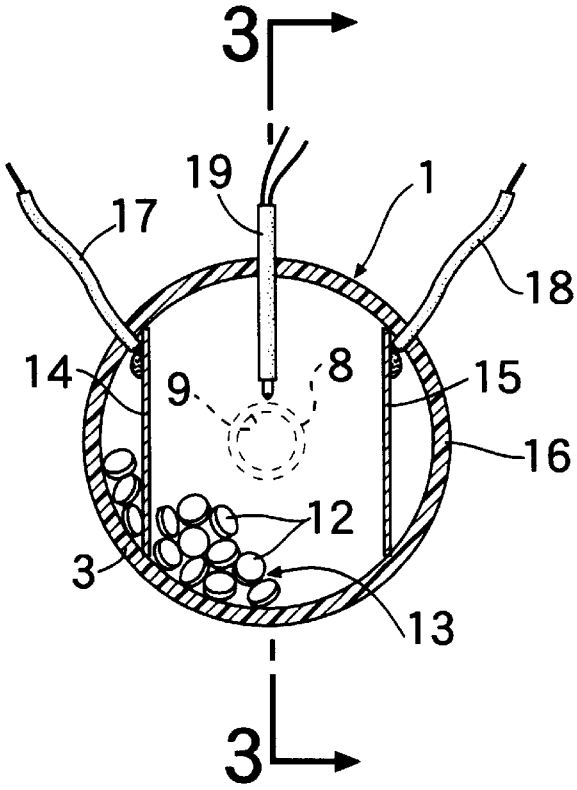
FIG. 2 is a sectional view along the line 2—2 of FIG. 1.
Figure 3:
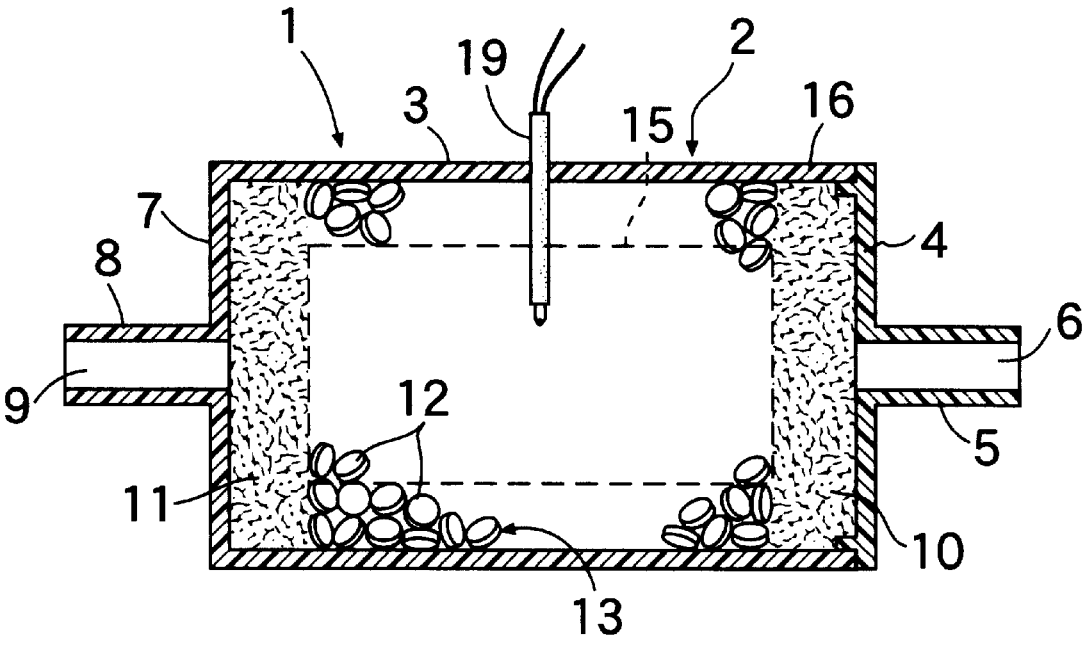
FIG. 3 is a sectional view along the line 3—3 of FIG. 2.

FIGS. 1 to 3 illustrate a canister 1 for preventing the emanation of a vaporized fuel gas. The canister 1 has a container 2 made of a polyamide 66, and the container 2 includes a cylindrical main body 3 with a bottom wall 7 and a closure plate 4 for closing the open ends of the cylinder. The closure plate 4 has a hollow cylindrical portion 5 which outwardly protrudes from the central portion thereof, and a vaporized fuel gas inlet port 6 is formed by the hollow cylindrical portion 5. The hollow cylindrical portion 5 is connected to a fuel tank that is not shown. The main body 3 has a hollow cylindrical portion 8 that outwardly protrudes from a central portion of the bottom wall 7, and a vaporized fuel gas exit port 9 is formed by the hollow cylindrical portion 8. The hollow cylindrical portion 8 is connected to an air intake system of an engine that is not shown.

Inside the container 2, there are provided filter layers 10 and 11 made of a glass wool in contact with the closure plate 4 and the bottom wall 7, respectively. The space between the two filter layers 10 and 11 is filled with an aggregate 13 of pelletized activated carbon 12 for adsorbing the vaporized fuel gas.

At least a pair of, and in this embodiment, a pair of aluminum plate electrodes 14 and 15 are mounted opposed to each other, on the inner surfaces of a peripheral wall 16 of the main body 3 and are buried in the aggregate 13. Lead wires 17 and 18 of the electrodes 14 and 15 extend outwards penetrating through the peripheral wall 16, and are connected to a DC power source device (not shown). The electrodes 17 and 18 are used for heating the activated carbon 12 through the resistance thereof. The main body 3 is further provided with a thermocouple 19 penetrating through the peripheral wall 16, the thermocouple 19 operates so that the temperature of the activated carbon 12 will not exceed a predetermined temperature.

As the activated carbon 12, there is used a highly electrically conductive activated carbon having an electric resistance of not larger than 500 $\Omega/2.5^3$ $cm^3$. The highly electrically conductive activated carbon 12 can be quickly heated through the resistance thereof up to a required temperature with the voltage of a 12 V battery mounted on a car. This makes it possible to effect the desorption of the vaporized fuel gas efficiently and to a sufficient degree. Furthermore, owing to its quick response, the desorption can be effected depending upon the operation conditions of the engine. Accordingly, the vaporized fuel can be reliably supplied to the engine.

At least part of the highly electrically conductive activated carbon in the aggregate 13 has an average porous diameter of not smaller than 7 Å and not larger than 37 Å. A highly electrically conductive activated carbon having such an average porous diameter adsorbs the vaporized fuel gas containing butane-type components to a sufficient degree.

Concretely described below is an example of using an n-butane (n-$C_4H_{10}$) as a vaporized fuel gas.

Figure 4:
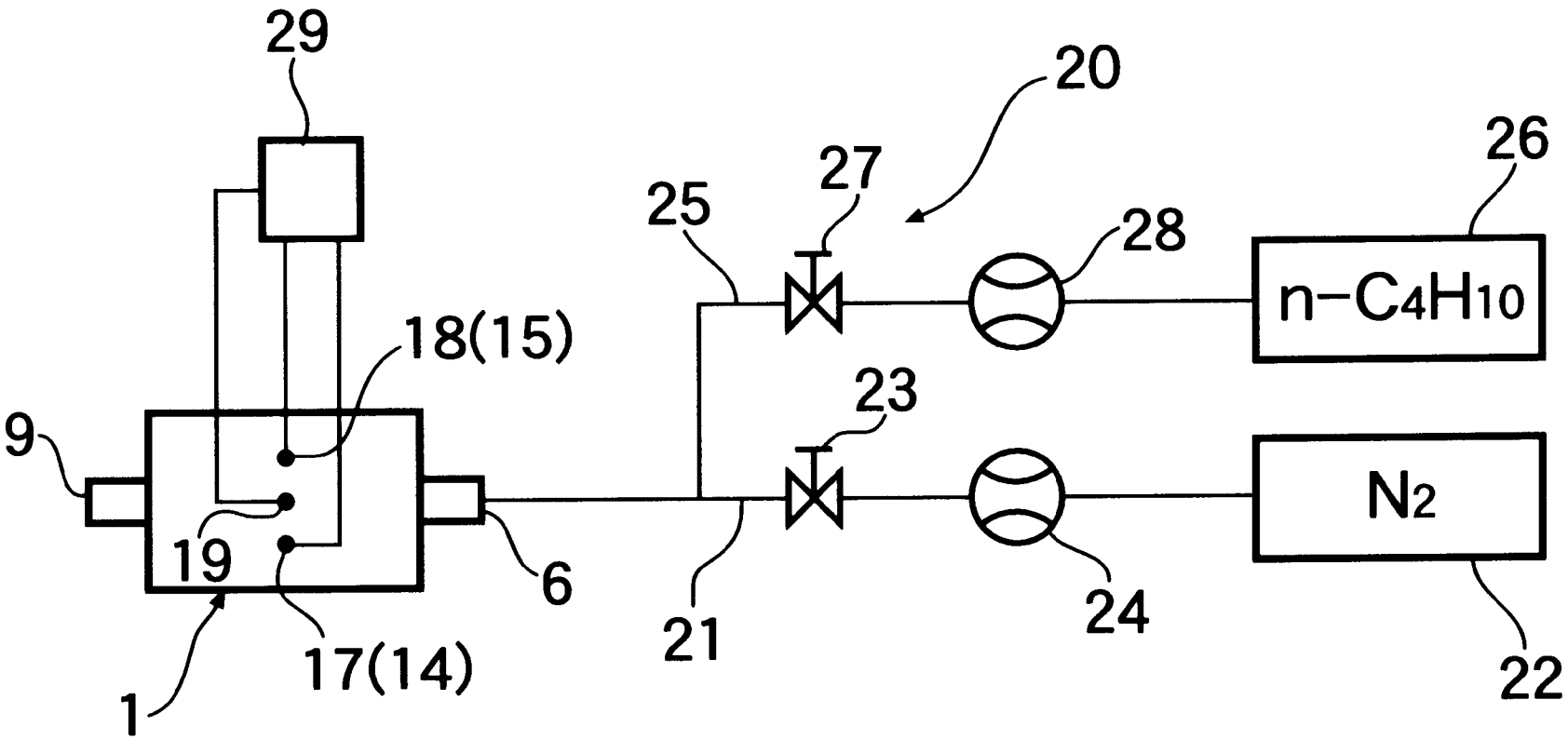
FIG. 4 is a diagram schematically illustrating a testing facility for adsorbing and desorbing of n-butane.

FIG. 4 illustrates a testing facility 20. In this testing facility 20, a nitrogen gas source 22 is connected to the inlet port 6 of the canister 1 through a first tubular passage 21. A first cock 23 and a first flow meter 24 are connected in the first tubular passage 21 extending from the side of the canister 1. Furthermore, an n-butane source 26 is connected, via a second tubular passage 25, to the first tubular passage 21 between the canister 1 and the first cock 23. A second cock 27 and a second flow meter 28 are connected in the second tubular passage 25 extending from the side of the canister 1.

The two lead wires 17 and 18 and the thermocouple 19 of the canister 1 are connected to a DC power source device 29 (regulated DC power supply, a maximum application voltage of 100 V, a maximum current of 20 A, manufactured by Kikusui Denshi Co.). The amount of current flowing between the two electrodes 14 and 15 is controlled depending upon the temperature data of the thermocouple 19, and the activated carbon 12 is maintained at a constant temperature.

The canister 1 has sizes as described below.

Container 2: the main body 3 has an inner diameter of 46 mm, a depth of 80 mm and a thickness of 2 mm.

Electrodes 14 and 15: 30 mm high, 60 mm wide, 1 mm thick, and separated apart by 35 mm from each other.

Activated carbon 12: pellets and contained in an amount of 100 $cm^3$, having a diameter of about 2 mm and a thickness of about 2 to 6 mm.

Figure 5:
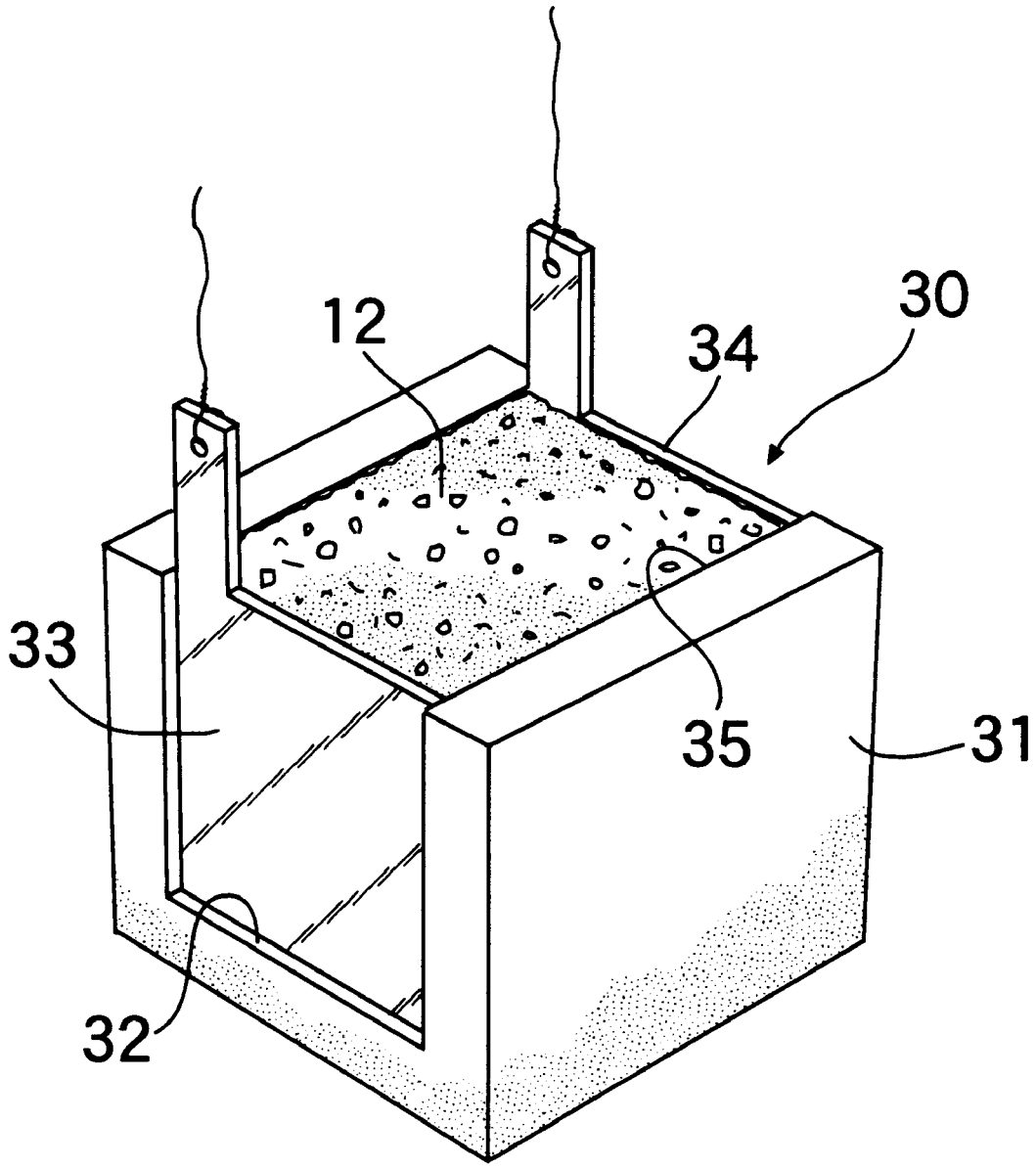
FIG. 5 is a perspective view of a cell for testing the residual effect of the electric resistance.

The electric resistance of the activated carbon 12 is measured by using an electric resistance measuring cell 30 (VOAC 7512, manufactured by Iwasaki Tsushinki Co.) shown in FIG. 5. The electric resistance measuring cell 30 comprises an electrically insulating channel member 31 made of an FRP, and a pair of aluminum plate electrodes 33 and 34 which are so installed as to close U-shaped openings 32 formed at both ends thereof. Space 35 between the two electrodes 33 and 34 is filled with the activated carbon 12. Then, the electric resistance between the two electrodes 33 and 34 is measured and the measured value is regarded to be the electric resistance of the activated carbon 12. Here, the space 35 has a volume measuring 2.5 cm high, 2.5 cm wide and 2.5 cm deep, i.e., has a volume of $2.5^3$ $cm^3$ (15.625 $cm^3$). Therefore, the electric resistance of the activated carbon 12 is expressed as ohms per $2.5^3$ $cm^3$.

The adsorption and desorption of n-butane were tested according to a procedure described below.

(a) First, the weight of the canister 1 that has not been used is measured.

(b) Referring to FIG. 4, the first tubular passage 21 is connected to the canister 1. In this case, the canister 1 is not connected to the DC power source device 29.

(c) The first cock 23 is opened, a nitrogen gas having a purity of 99.999% is supplied from the nitrogen gas source 22 into the canister 1 at a flow rate of one liter a minute for 5 minutes through the inlet port 6 being directed to the exit port 9 to substitute the gas in the canister 1 with the nitrogen gas.

(d) While the nitrogen gas is being supplied under the abovementioned conditions, the second cock 27 is opened, and the n-butane having a purity of 99% is supplied from the n-butane source 26 at a flow rate of one liter a minute. That is, a mixed gas of nitrogen gas and n-butane is supplied into the canister 1 through the inlet port 6 being directed to the exit port 9, and the amount of n-butane adsorbed by the activated carbon 12 is measured with the passage of time. To measure the amount of adsorption, the first tubular passage 21 is disconnected from the canister 1 after the passage of a predetermined period of time, and the weight of the canister 1 is measured. From the measured weight is subtracted from the weight of the canister 1 before being tested, and the difference is regarded to be an adsorbed amount of n-butane.

When the mixed gas is allowed to flow for about 10 minutes, the adsorption of n-butane by the activated carbon 12 reaches the saturated state. Therefore, the supply of the mixed gas is discontinued and, then, the adsorbed amount of n-butane is determined, i.e., a maximum amount of adsorption is found.

(e) The first tubular passage 21 and the DC power source device 29 are connected to the canister 1.

(f) Presuming a battery mounted on a car with a voltage of 12 V is applied across the two electrodes 14 and 15 from the DC power source device 29 in order to heat the activated carbon 12 through the resistance thereof. Here, the amount of current is adjusted depending upon the temperature data from the thermocouple 19, and the temperature of the activated carbon 12 is controlled not to exceed 120° C.

The first cock 23 is opened, the nitrogen gas having a purity of 99.999% is supplied from the nitrogen gas source 22 into the canister 1 at a flow rate of two liters a minute for 20 minutes through the inlet port 6 being directed to the exit port 9, to effect the desorption of butane while measuring the residual amount of n-butane with the passage of time. The residual amount is measured by measuring the weight of the canister 1 in the same manner as described above. After the nitrogen gas is allowed to flow for 20 minutes, the weight of the canister 1 before being tested is subtracted from the weight of the canister 1 after the testing, in order to find the finally residual amount of n-butane.

Table 1 shows characteristics of the activated carbons used in the tests 1 to 6.

TABLE 1

| Test No. | Material | Electric Resistance ($\Omega/2.5^3$ cm$^3$) | Average porous diameter (Å) |
|---|---|---|---|
| 1 | Coconut shell | 296 | 17 |
| 2 | Coal | 108 | 27 |
| 3 | Phenolic resin | 21 | 37 |
| 4 | Coconut shell | 497 | 7 |
| 5 | Coconut shell | 350 | 4 |
| 6 | Wood | 627 | 45 |

Table 2 shows maximum temperatures of the activated carbon being tested, maximum amounts of adsorption of n-butane, effective amounts of adsorption and finally residual amounts in test Nos. 1 to 6. Here the effective amount of adsorption stands for a value obtained by subtracting the finally residual amount from the maximum amount of adsorption, i.e., stands for the amount of desorption of n-butane.

TABLE 2

| Test No. | Max. temp. of activated Carbon (° C.) being tested | n-Butane Max. amount of adsorption (g) | n-Butane Effective amount of adsorption (g) | n-Butane Residual amount (g) |
|---|---|---|---|---|
| 1 | 83 | 9.4 | 9.3 | 0.1 |
| 2 | 95 | 9.1 | 9.0 | 0.1 |
| 3 | 120 | 8.7 | 8.5 | 0.2 |
| 4 | 70 | 7.7 | 7.5 | 0.2 |
| 5 | 77 | 5.1 | 4.9 | 0.2 |
| 6 | 60 | 6.3 | 5.4 | 0.9 |

Figure 6:
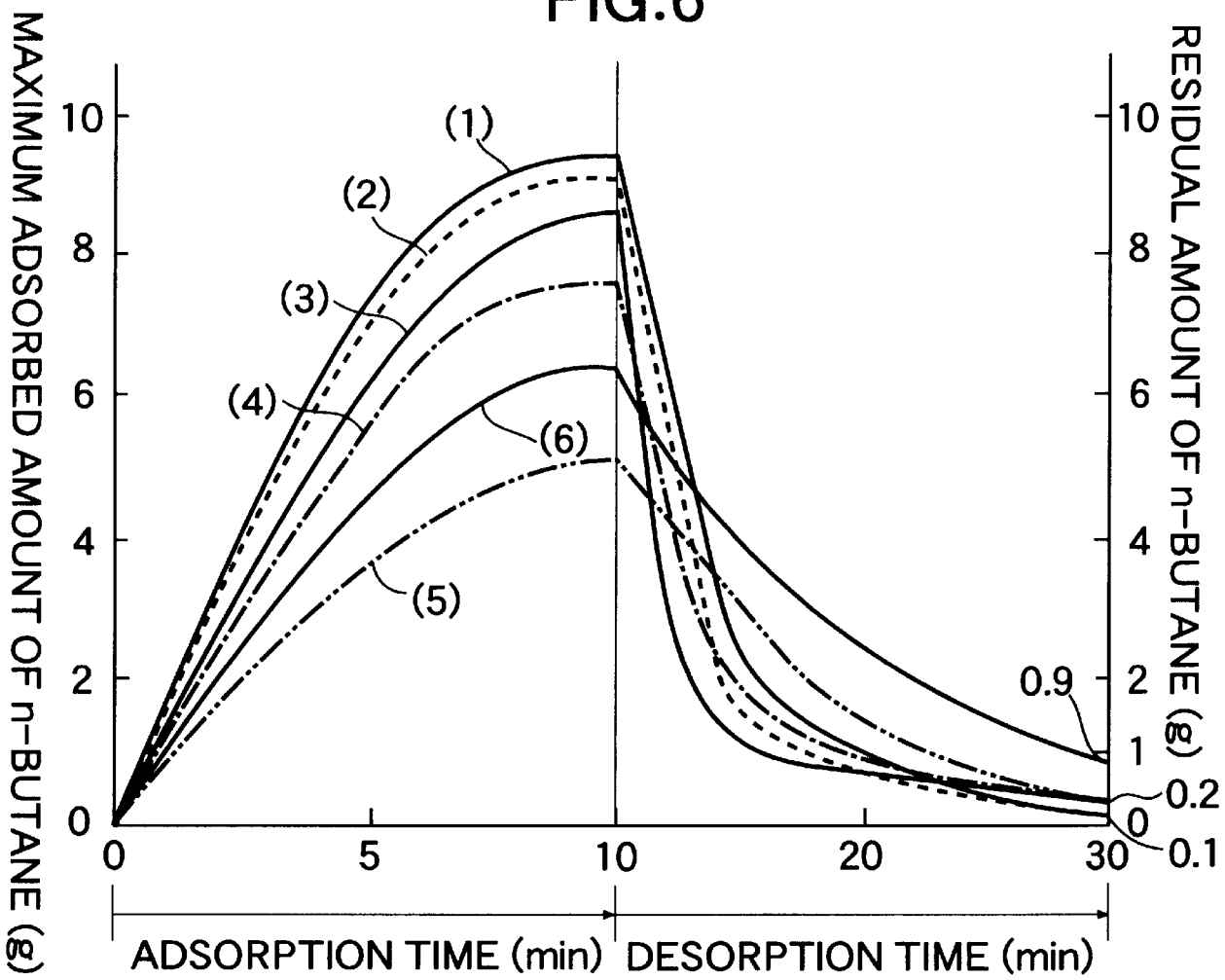
FIG. 6 is a graph showing the relationship between the adsorption times and the adsorbed amounts of n-butane, and the relationship between the desorption times and the residual amounts of n-butane.

FIG. 6 illustrates the relationship between the adsorption times and the maximum adsorbed amount of n-butane and relationship between the desorption times and the residual amount related to test Nos. 1 to 6. In FIG. 6, numerals (1) to (6) correspond to test Nos. 1 to 6, respectively. This relationship is analogous in the subsequent drawings, also. It will be understood from FIG. 6 that the adsorption of n-butane reaches the saturated state in 10 minutes after the start of the testing and, thereafter, the desorption of n-butane takes place.

The average gas desorption rates during two minutes from the start of desorption were as set forth below in, for example, test Nos. 3, 4 and 6.

Test No. 3 3.75 g/min.

Test No. 4 2.50 g/min.

Test No. 6 1.15 g/min.

Figure 7:
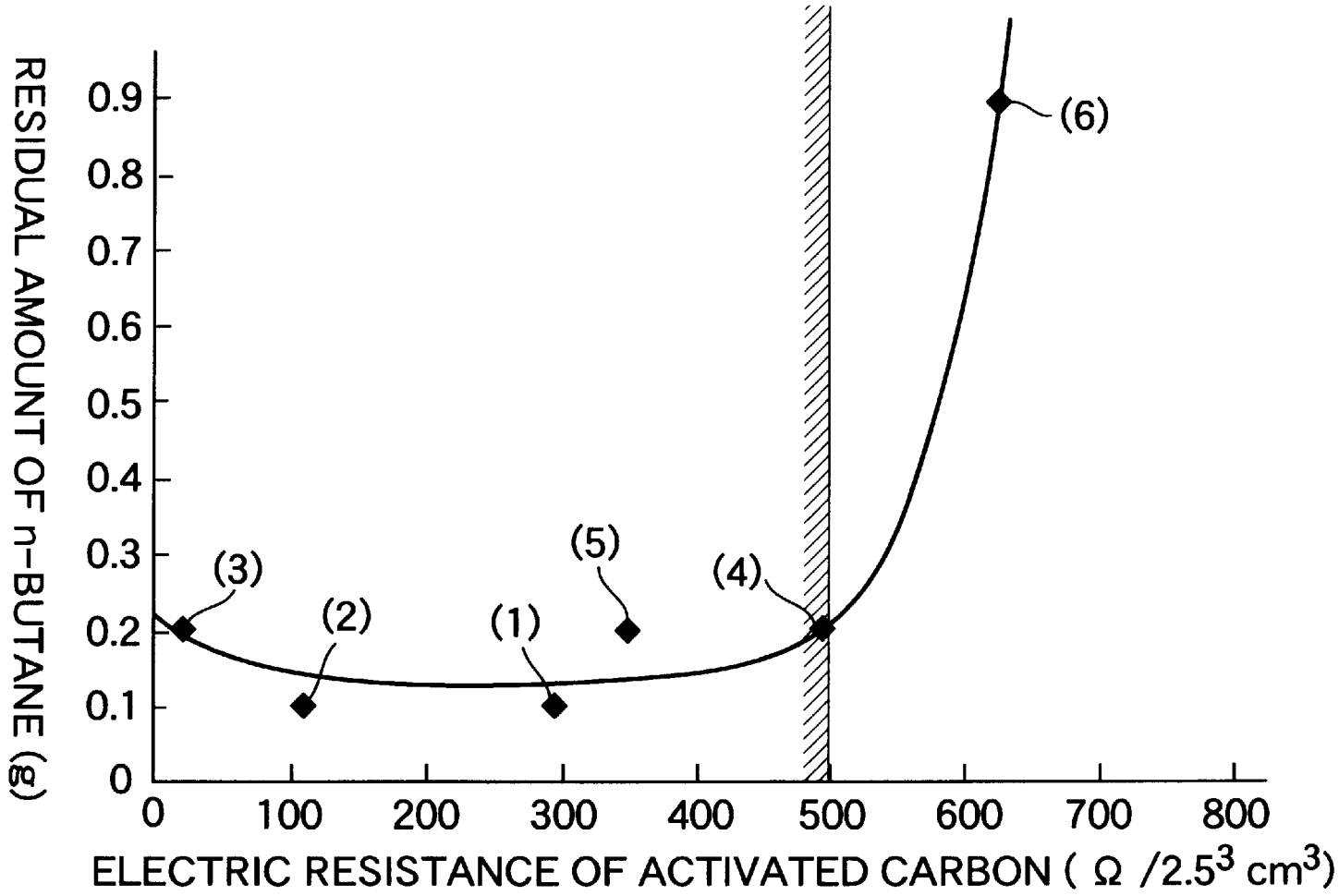
FIG. 7 is a graph showing the relationship between the electric resistance of the activated carbon and the residual amount of n-butane.

FIG. 7 is a graph showing the relationship between the electric resistance of the activated carbon and the residual amounts of n-butane in the test Nos. 1 to 6 based upon Tables 1 and 2. As will be obvious from Table 2 and FIG. 7, the highly electrically conductive activated carbon having an electric resistance of not larger than 500 $\Omega/2.5^3$ cm$^3$ can be heated through the resistance of the activated carbon at a temperature of not lower than 70° C. with a voltage which is as low as 12 V as is done in test Nos. 1 to 5 and, thus, the n-butane is desorbed efficiently and to a sufficient degree.

Figure 8:
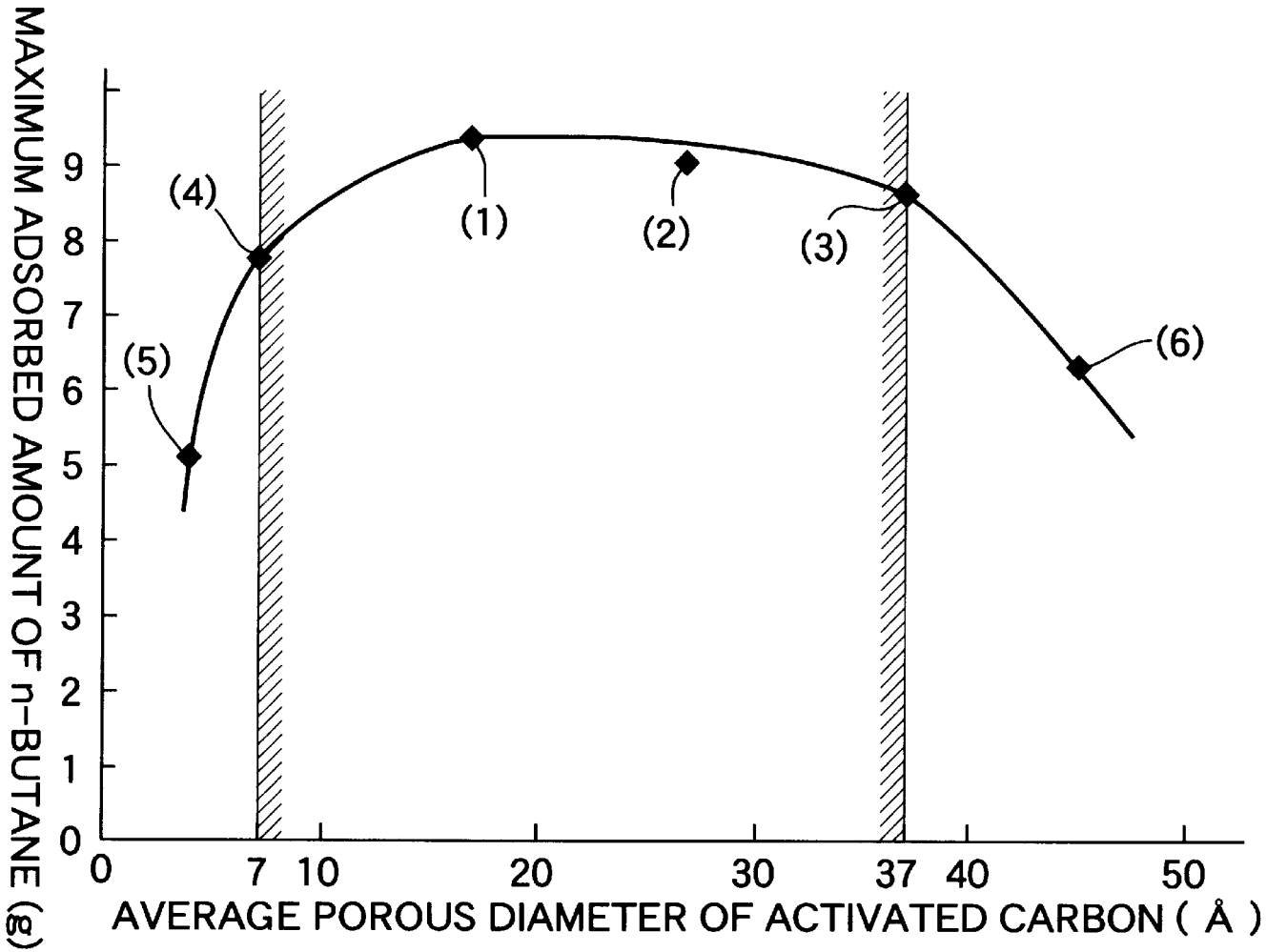
FIG. 8 is a graph showing the relationship between the average porous diameters of the activated carbon and the maximum adsorbed amount of n-butane.

FIG. 8 is a graph showing the relationship between the average porous diameters of the activated carbon and the maximum adsorbed amount of n-butane in the test Nos. 1 to 6 based upon Tables 1 and 2. As will be obvious from FIG. 8, when the highly electrically conductive activated carbon having an average porous diameter of not smaller than 7 Å and not larger than 37 Å is used as in test Nos. 1 to 4, the maximum adsorbed amount of n-butane can be increased. In this case, a corresponding effect can be obtained even when the aggregate of activated carbon partly contains the highly conducting activated carbon having the above-mentioned average porous diameter.

Figure 9:
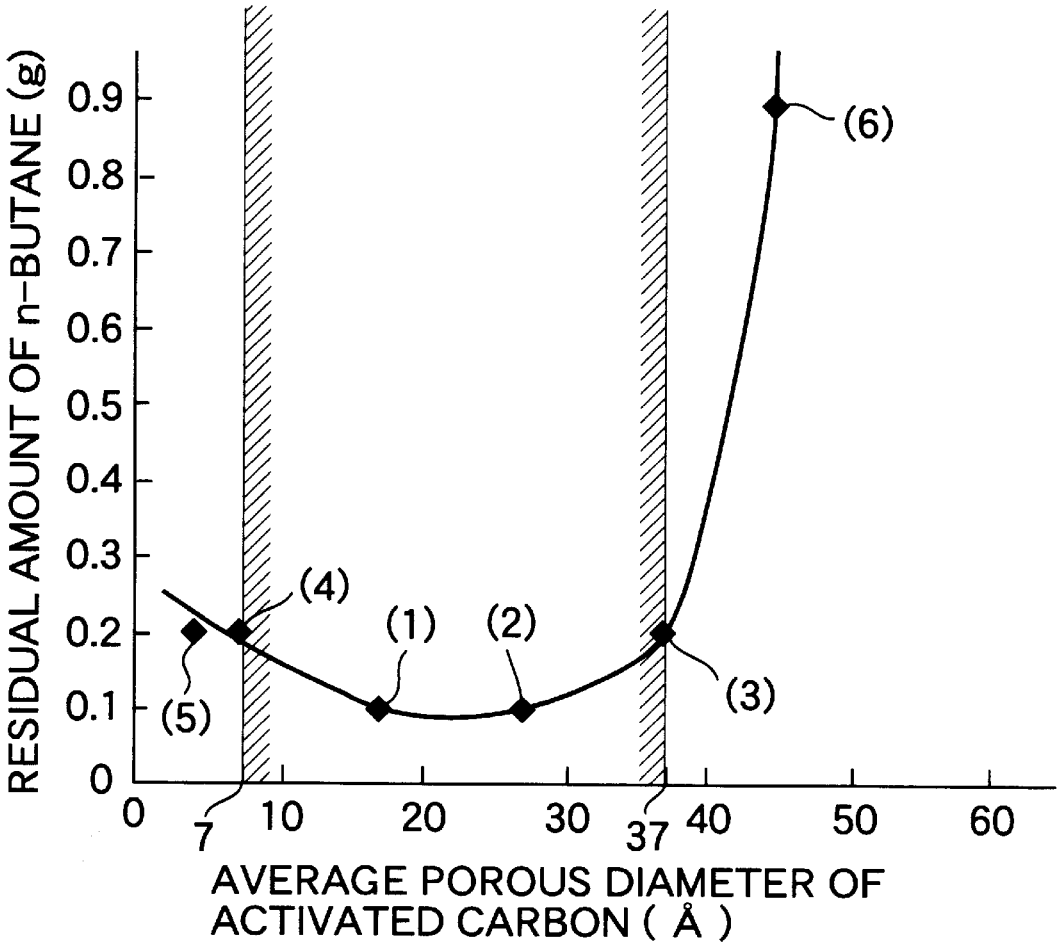
FIG. 9 is a graph showing the relationship between the average porous diameter of the activated carbon and the residual amount of n-butane.

FIG. 9 is a graph showing the relationship between the average porous diameter of the activated carbon and the residual amount of butane in the test Nos. 1 to 6 based upon Tables 1 and 2. As will be obvious from FIG. 9, when the highly electrically conductive activated carbon, having an average porous diameter of not smaller than 7 Å and not larger than 37 Å is used as in test Nos. 1 to 4, the residual amount of n-butane also tends to decrease.

According to the present invention, there is provided a canister as described above, which is capable of desorbing the vaporized fuel gas efficiently and to a sufficient degree by quickly heating the activated carbon through the resistance of the activated carbon up to a required temperature at the time of desorption of the vaporized fuel gas.

Further, there is provided a canister capable of adsorbing the vaporized fuel gas to a sufficient degree in addition to obtaining the above-mentioned effect.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. A canister for preventing the emanation of a vaporized fuel gas, comprising a container having a vaporized fuel gas inlet port and an exit port, an aggregate of activated carbon within the container for adsorbing the vaporized fuel gas, and at least a pair of electrodes for heating the activated carbon through the resistance thereof, at the time of desorption of the vaporized fuel gas, wherein the activated carbon is highly electrically conductive and has an electric resistance of not larger than 500 $\Omega/2.5^3$ cm$^3$.

2. A canister according to claim 1, wherein at least part of the highly electrically conductive activated carbon in the aggregate has an average porous diameter of not smaller than 7 Å and not larger than 37 Å.

* * * * *